US006179010B1

(12) United States Patent
Tseng

(10) Patent No.: US 6,179,010 B1
(45) Date of Patent: Jan. 30, 2001

(54) WEAVING METHOD TO PUT LASER-PROCESSED DIAGRAM SHEETS ONTO BAND WITHOUT SPOILING THE DIAGRAM

(76) Inventor: Ching-Min Tseng, No. 53, Tseng Gia Village, Sen Kan Hsiang, Changhua Hsien (TW)

( * ) Notice: Under 35 U.S.C. 154(b), the term of this patent shall be extended for 0 days.

(21) Appl. No.: 09/501,963

(22) Filed: Feb. 10, 2000

(51) Int. Cl.[7] ..... D03D 00/00
(52) U.S. Cl. ..... 139/1 R; 139/35; 139/317
(58) Field of Search ..... 139/1 R, 35, 317

(56) References Cited

U.S. PATENT DOCUMENTS 5,791,392 * 8/1998 Lopez ..... 160/238

* cited by examiner

*Primary Examiner*—John J. Calvert
*Assistant Examiner*—Robert Moromoto, Jr.
(74) *Attorney, Agent, or Firm*—Dougherty & Troxell

(57) ABSTRACT

A weaving method to put laser sheet onto weaving band without spoiling the diagrams printed on the laser sheet is disclosed. In the first step, a laser-processed diagram sheet is cut into a plurality of delicate strips a certain amount of which are then rolled up in group at one end onto each of a number of shuttles. The rolled sheet strips on a number of shuttles are used as warp yarns and natural fabric fibers are used as weft yarns so that a woven fabric on a weaving machine is obtained from the interwoven warp yarns and weft yarns. Thereby a woven fabric provided with colorful laser-processed diagram can produce colorful and three-dimensional illumination effect when light is shed onto a fabric band

1 Claim, 4 Drawing Sheets

SELECTING A ROLL OF GOLD RIMMED PAPER OF A PROPER WIDTH.

↓

PUTTING THE ROLL OF GOLD RIMMED PAPER ON A STRIIP CUTTER,AND CUTTING THE GOLD RIMMED PAPER INTO A PLURALITY OF STRIPS WHICH ARE WOUND UP ON A SHUTTLE ONE BY ONE RESPECTIVELY.

↓

USING THR ROLLED GOLD RIMMED STRIPS AS WARP YARNS AND A NUMBER OF NATURAL FABRIC FIBERS AS WEFT YARNS TO WEAVE ON A WEAVING MACHINE.

↓

WEAVING THE YARNS INTO A LONG AND FLAT FABRIC BAND

FIG.2
PRIOR ART

SELECTING A PIECE OF LASER PROCESSED SHEET OF PROPER WIDTH WITH COLORFUL DIAGRAMS ON IT.

↓

CUTTING THE LASER PROCESSED SHEET INTO A PLURALITY OF STRIPS WHICH ARE ROLLED UP WITH A NUMBER OF STRIPS IN GROUP AT ONE END ON A NUMBER OF SHUTTLES WHICH ARE LESS IN NUMBER WHEN THE BAND TO BE WOVEN IS WIDE AND MORE IN NUMBER WHEN THE BAND TO BE WOVEN IS NARROW; THE ROLLS OF STRIPS ARE ARRANGED IN SUCH A MANNER THAT THE COLORFUL DIAGRAMS ON THE CUT STRIPS CAN BE RE-GROUPED INTO THE ORIGINAL DIAGRAMS ON THE SHEET.

↓

USING THE ROLLED STRIPS OF THE LASER SHEET AS WARP YARNS AND NATURAL FABRIC FIBERS AS WEFT YARNS TO WEAVE INTO A BAND ON A WEAVER.

↓

PRODUCING A LONG AND FLAT BAND WITH AN INTEGRAL LASER PROCESSED DIAGRAM SHOWN ON THE BAND.

FIG. 4

WEAVING METHOD TO PUT LASER-PROCESSED DIAGRAM SHEETS ONTO BAND WITHOUT SPOILING THE DIAGRAM

BACKGROUND OF INVENTION

1. Technical Field of the Invention

The present invention relates to a weaving method to put a laser-processed diagram sheet onto a woven band without spoiling the diagrams printed on the sheet. In a first step, a laser-processed diagram sheet is cut into a plurality of delicate strips a number of which are then rolled up in a group at one end onto one of a plurality of weaver's shuttles respectively. The weaver's shuttles with grouped delicate strips are arranged in such an order that the rolled laser-processed diagram strips on the shuttles are interwoven as warp yarns with natural fabric fibers used as weft yarns with the diagram wholly and easily reproduced without damage. Besides, colorful and three-dimensional illumination effects can be obtained when light is shed onto such a woven fabric.

2. Prior Art

In general, the conventional method of weaving gold rimmed strip rolls 10 on a fabric band is illustrated in FIGS. 1, 2. In the first step, a gold rimmed sheet 10 of proper width is cut into a plurality of delicate strips 10' by a strip cutting machine One end of each cut strip 10' is respectively rolled up on one of a plurality of weaver's shuttles 20 and served as warp yarns so that natural fabric fibers 30 served as weft yarns are interwoven with the warp yarns to produce an elongated and flat fabric band 40 by means of a weaving machine.

Such a conventional weaving method of putting gold-rimmed sheet 10 into a fabric band has the following disadvantages:

1. A gold-rimmed sheet 10 is cut into strips 10' which are rolled upon a weaver's shuttle respectively and woven into a fabric band with natural fibers so that light shed on such a fabric band can only produce bright and shiny effect which is simple and monotonous without any artistic value.

2. If a diagram is shown on a gold-rimmed sheet 10, such a weaving method will spoil the diagram in weaving if so many shuttles are not properly arranged in order.

SUMMARY OF THE INVENTION

Therefore, the primary object of the present invention is to provide a method of weaving a fabric with a laser sheet woven thereon without spoiling the diagram on that laser sheet which is first cut into a plurality of elongated strips. A certain amount of the cut sheet strips are then rolled up on each of a selective number of weaver's shuttles instead of upon individual weaver's shuttles and interwoven with natural fabric fibers into a long and flat band whereby when light is shed on the woven fabric band, bright and 3-dimensional diagram will show up on the fabric band without spoiling.

Another object of the present invention is to provide a method of weaving a fabric band with a laser-processed diagram sheet woven thereon. In such a method the diagram appears on the laser-processed diagram sheet be reproduced on a woven fabric with the colorful and 3-dimensional diagram shown on that laser sheet not slightly damaged at all.

BRIEF DESCRIPTION OF THE DRAWINGS

FIG. 2 is a flow chart showing the process of a prior art method;

FIG. 4 is a flow chart showing the process of the method of the present invention.

DETAILED DESCRIPTION OF THE PREFERRED EMBODIMENT

Figure 1:
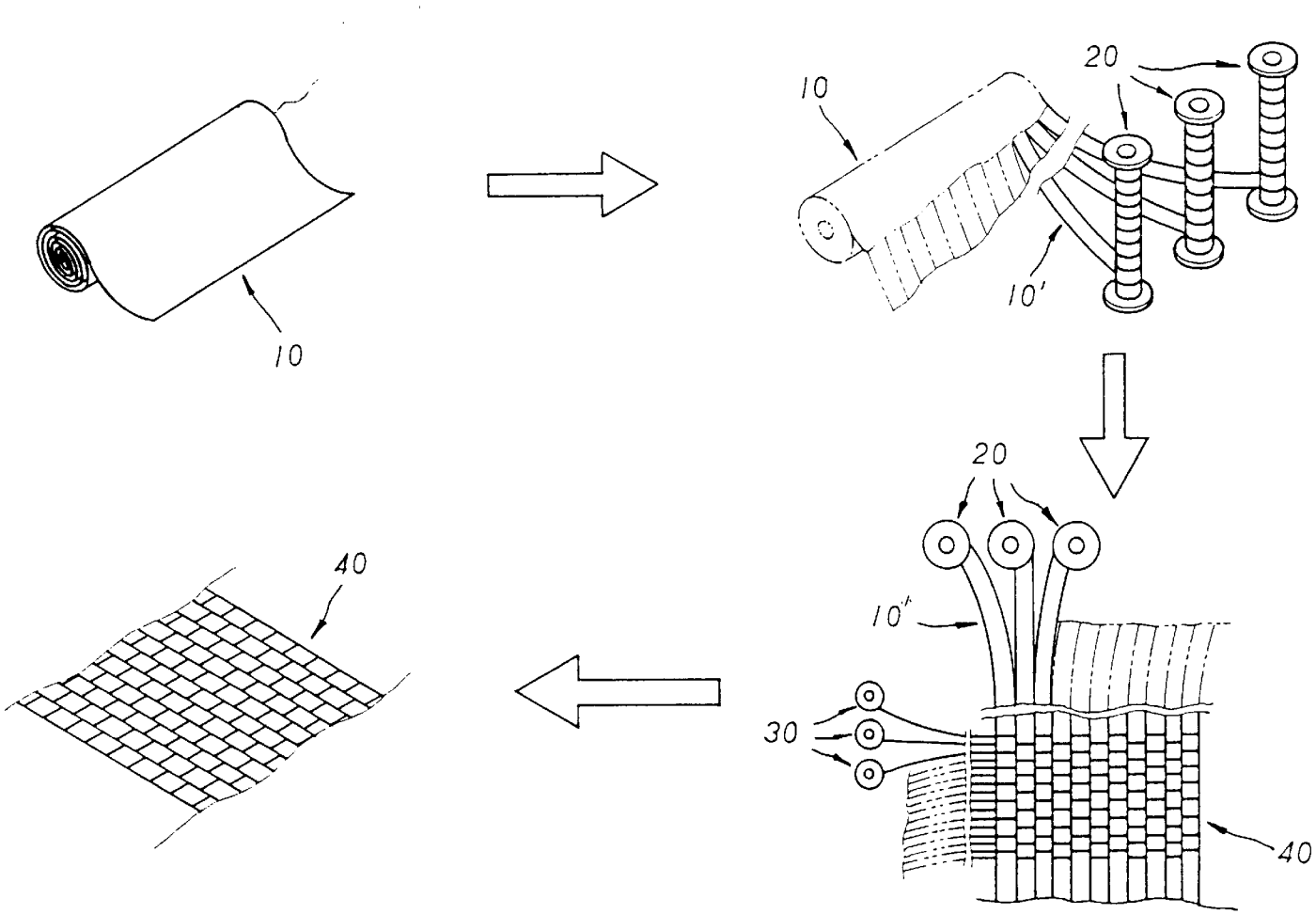
FIG. 1 PRIOR ART
FIG. 1 is a diagram showing the flow of the production of a fabric with gold-rimmed strips of a prior art method.
Figure 3:
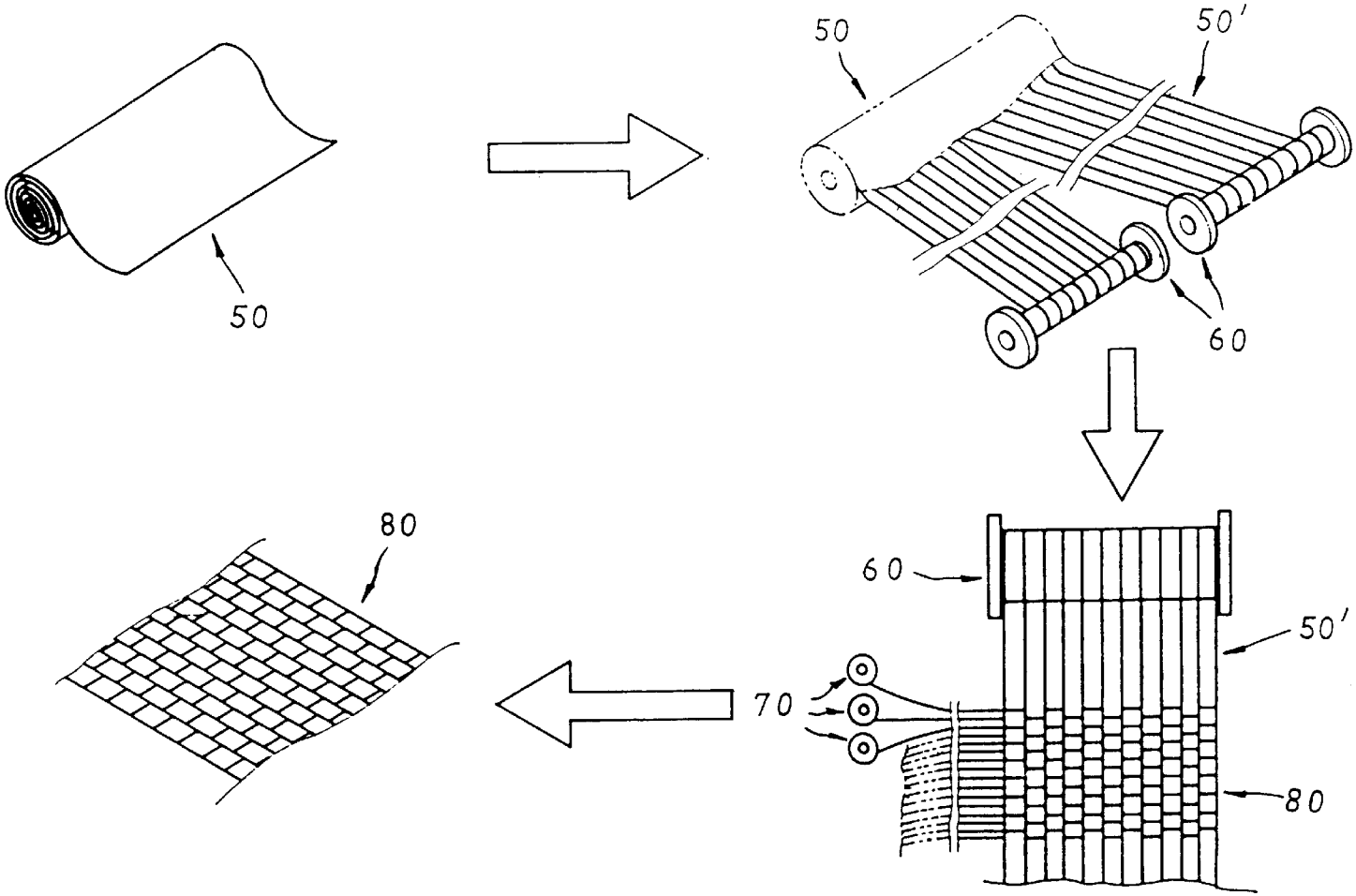
FIG. 3 is a diagram showing the flow of the production of a laser sheet woven fabric of the present invention.

Referring to FIG. 3, the flow procedures and flow chart of the production of the present invention are illustrated. First, a colorful laser-processed diagram sheet 50 having a proper width is fed into a strip-cutting machine to obtain a plurality of elongated strips 50' which are rolled up in selective amount onto one of a selective number of weaver's shuttles 60 at one end. The number of used weaver's shuttles is determined by the width of a woven fabric band 80 and the wider a fabric band 80, the lesser the number of the weaver's shuttles used in the present invention and vice versa, the more the weaver's shuttles used. The rolled cut sheet strips 50' on the weaver's shuttles 60 are integrated to reproduce a whole diagram original laser sheet 50 when assembled together piece by piece. A certain number of sheet strips 50' rolled up on a number of weaver's shuttles 60 are served as warp yarns and thin and delicate natural fabric fibers 70 are served as weft yarns. Thereby, the yarns are intenvoven by way of a weaving machine to produce an elongated and flat fabric band 80 with a laser-processed diagram reproduced without spoiling.

The advantages of the cited method of the present invention are given as follows:

1. The laser sheet 50 is cut into a plurality of elongated strips 50' certain amount of which are rolled up in group on each of a selected number of weaver's shuttles as warp yarns and then interwoven with natural fabric fibers as weft yarns so as to produce a fabric band which can produce colorful and 3-dimensional effect when light is shed thereon.

2. The weaving steps permit a diagram on a laser sheet which are cut into strips and served as warp yarns to be interwoven in order on a fabric band with delicate natural fabric fibers served as weft yarns whereby the colorful diagram can be wholly transformed onto the fabric band and clearly shown as a whole even partially covered with the delicate and thin weft yarns.

I claim:

1. A weaving method to put laser-processed diagram sheet to woven band without spoiling the diagram wherein said weaving method includes steps:

(a) selecting a laser-processed diagram sheet of a proper width;

(b) cutting said laser-processed diagram sheet into a plurality of elongated strips a certain of amount of which are rolled up in group at end on each of a number of weaver's shuttles, instead of rolling up each said strip on a weaver's shuttle;

(c) using the rolled strips as warp yarns and natural fabric fibers as weft yarns that are interwoven on a weaving machine;

(d) interveaving said warp yarns and said weft yarns into a woven band so as to reproduce said laser-processed diagram on said woven band.

* * * * *